United States Patent [19]

Duba

[11] 4,302,744

[45] Nov. 24, 1981

[54] RESISTOR

[75] Inventor: David E. Duba, Frazier Park, Calif.

[73] Assignee: Microplex, Inc., Santa Ana, Calif.

[21] Appl. No.: 164,313

[22] Filed: Jun. 30, 1980

[51] Int. Cl.[3] ..... H01C 1/012

[52] U.S. Cl. ..... 338/314; 333/185; 338/308; 338/334

[58] Field of Search ..... 338/314, 307–309, 338/325, 324, 333, 334; 361/274; 357/40; 333/172, 185

[56] References Cited

U.S. PATENT DOCUMENTS

| | | | |
|---|---|---|---|
| 2,523,856 | 9/1950 | Baker | 338/334 |
| 3,665,346 | 5/1972 | Orr | 333/172 |
| 3,892,272 | 7/1975 | Smolko et al. | 338/334 X |

OTHER PUBLICATIONS

D. G. Hilson, et al., *Solid State Technology,* "New Materials for Low Cost Thick Film Circuits", pp. 49–54, Oct. 1977.

Spector, *Electronics,* "Porcelain-On-Steel Boards Can Launch a Thousand Chips", pp. 125–128, Mar. 15, 1979.

R. E. Herbaugh, *Microwaves,* "Can Porcelain-Steel Substrates Replace Expensive Alumina", pp. 11 & 14, Jul. 1979.

*Primary Examiner*—C. L. Albritton

*Attorney, Agent, or Firm*—Edward D. O'Brian

[57] ABSTRACT

A resistor capable of being used as an RC network can be constructed using an electrically conductive metal sheet coated with a dielectric coating serving as a substrate. The dielectric coating supports two separate resistor terminals and a resistance element extending between these terminals. A third terminal is provided for use in connecting the metal sheet to one of the resistor terminals so that the resistor may be used as an RC network.

6 Claims, 1 Drawing Figure

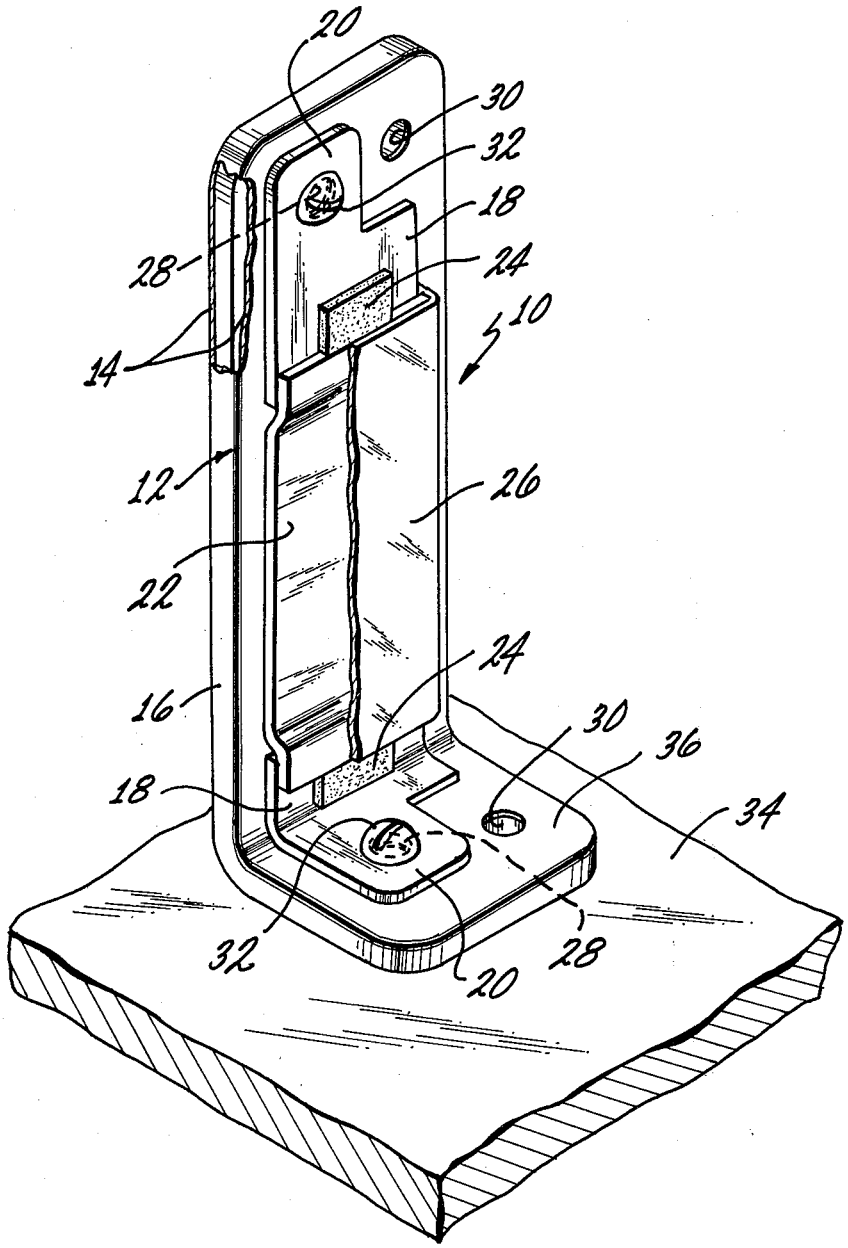
20
30
32
18
28
24
10
14
12
26
22
24
16
30
36
18
34
32
20
28

RESISTOR

BACKGROUND OF THE INVENTION

This invention pertains to new and improved electrical resistors. More specifically it pertains to electrical resistors which are capable of being utilized in some applications as RC networks and which can also be utilized as normal resistors.

As the related electrical and electronic fields have developed many different resistors have been developed for many different uses and applications. Frequently such resistors are created or manufactured by locating a film or coating serving as a resistance element on an appropriate dielectric substrate so that the resistance film extends between electrical terminals located on the substrate. Frequently such resistors are manufactured as an integral part of a circuit "board" or "structure" containing a variety of different terminals, conductors extending between such terminals and such resistance elements. At times such circuit "boards" or "structures" may also contain inductors and capacitors.

Many of such circuit "boards" have been constructed utilizing an electrically non-conductive substrate formed of an appropriate organic resin composition. Although such substrates have proved to be very utilitarian for use in connection with circuit components as noted, they are somewhat disadvantageous for certain applications because of the fact that comparatively elevated temperatures will detrimentally affect any organic material. To a degree this complication can be alleviated by the use of an electrically non-conductive ceramic substrate. The use of such ceramic substrates in many applications is disadvantageous because of their weight and because of the fact that they are somewhat prone to physical damage.

A recognition of these factors has resulted in a resurgence of past techniques of utilizing steel coated with a dielectric material as a substrate for circuit structures as indicated in the preceding discussion. The steel possesses good physical characteristics which are apt to preclude damage. Further, so long as the dielectric used with the steel is ceramic, the entire substrate can withstand comparatively high temperatures such as would normally damage various types of essentially organic substrates. Circuit boards or structures as indicated in this discussion normally utilize many different resistors, conductors and terminals as indicated in the preceding discussion. They cannot be used as simple, effective RC networks although they can be and frequently are used as more complex networks.

BRIEF SUMMARY OF THE INVENTION

A broad object of the present invention is to provide new and improved electrical resistors. More specifically the invention is intended to provide resistors which utilize the coated metal substrate of the resistor as a "functional" component so that the resistor itself may be utilized either as a conventional resistor or as an RC network. The invention is also intended to provide new and improved resistors as noted which may be easily and conveniently manufactured at a comparatively nominal cost, which are suitable for comparatively high temperature utilization, and which are capable of withstanding significant physical abuse.

In accordance with this invention these various objectives are achieved by providing a resistor comprising a substrate having a surface, a resistance element means located on said surface of said substrate, a resistor terminal means in contact with one of said ends, another resistor terminal means in contact with the other of said ends, both of said resistor terminal means being supported by said substrate, the improvement which comprises said substrate comprising an electrically conductive metal sheet having a dielectric coating adhered to one surface thereof, said dielectric coating serving as said surface of said substrate, and third terminal means for use in connecting said metal sheet to one of said resistor terminal means whereby said resistor may be utilized either as a resistor or as an RC network depending upon whether or not said third terminal means is connected to said metal sheet.

BRIEF SUMMARY OF THE DRAWING

Because of the nature of this invention it is best more fully explained with reference to the accompanying drawing in which the FIGURE is an isometric view of a resistor in accordance with this invention in which part of a dielectric coating used with the resistor has been broken away so as to facilitate an understanding of various "internal" parts within the resistor.

The resistor illustrated in the drawing may be regarded as a presently preferred embodiment or form of the invention in the sense that it embodies as many aspects or features of the invention as can be incorporated within a single unit. From a commercial standpoint it is preferred to manufacture resistors which correspond to the resistor shown in the sense that they utilize operative concepts and principles as are embodied within the illustrated resistor but which do not utilize all of the aspects or features incorporated within the resistor illustrated.

These concepts and/or principles of the invention are set forth and defined in the appended claims forming a part of this disclosure. Those skilled in the field of the present invention will realize that these concepts or principles may be easily incorporated within a variety of somewhat differently appearing and somewhat differently constructed units through the use or exercise of routine skill in the field of the manufacture of components such as resistors and capacitors.

DETAILED DESCRIPTION

In the drawing there is shown a resistor 10 in accordance with this invention which utilizes an elongated sheet steel "chip" 12 having its opposed surfaces covered with identical, adherent, electrically non-conductive dielectric coatings 14. Although these coatings 14 may be of an organic resin or polymer or may consist of a series of inorganic particles bonded together by means of an appropriate organic binder, it is considered highly preferable for these coatings 14 to be inorganic porcelain coatings because of their resistance to elevated temperature. Such porcelain coatings 14 may be formed in accordance with known and conventional technology. If desired, these coatings 14 may cover the edge 16 of the "chip" 12.

One of the coatings 14 is provided with two opposed resistor terminals 18. These terminals 18 are spaced from one another and preferably, but not necessarily, include tab-like extensions 20. These terminals 18 may be created in a number of different known manners. Thus, for example, they may be created by utilizing a conventional electrically conductive silver "ink" which is fired so as to adhere to the coating 14.

A conventional resistance element 22 is located on the coating 14 so as to extend between and so as to slightly overlie the resistor terminals 18. Here again the resistance element 22 can be manufactured in a variety of different ways. Thus, for example, it can be manufactured utilizing conductive particles such as carbon black particles or certain metal particles in an appropriate organic binder utilizing known printed circuit techniques. It is preferred, however, to utilize with the invention a conventional ruthenium oxide resistance element in which a glass or glassy type binder serves to hold the resistance particles in place. Such a binder will tend to adhere effectively to the dielectric coating 14 adjacent to the element 22 so as to form a "good" bond with this coating 14.

In order to facilitate the use of the resistor 10 conventional solder deposits 24 may be located on the resistor terminals 18 as shown so that these terminals 18 may be directly soldered into a conventional circuit. Preferably a conventional dielectric coating 26 of either an organic or inorganic type is then located over the entire resistance element 22 and at least portions of the resistance terminals 18 as shown for the obvious purpose of protecting the resistance element 22 and of insuring against a shorting out between the terminals 18 as a result of the presence of moisture, a conductor or the like.

The resistor 10 is also constructed so that there is a hole 28 through each of the tab-like extensions 20 and through the adjacent portions of the steel "chip" 12 and the coatings 14 on the chip 12. Further, there are other holes 30 which are located so as to extend only through the steel chip 12 and the adjacent portions of the coating 14 immediately adjacent to each of the terminals 18. These holes 30 are intended to be utilized in mounting the resistor 10 in an operative position.

If the resistor 10 is to be utilized only as a resistor an appropriate fastener 32 such as a self-tapping screw, a machine screw or the like may be utilized in connection with one or both holes 30 in securing the resistor 10 in place on a support 34. When, however, the resistor 10 is to be utilized as an RC network, a hole 28 in connection with one of the resistance terminals 18 such as the uppermost terminal 18 must be used with a fastener 32 so as to establish electrical conduction between this terminal 18 and the steel chip 12. A similar fastener 32 may be used to establish a connection between the other, lower terminal 18 and the support 34. Either this fastener 32 should be sized so as not to contact the chip 12 in projecting through the hole 28 within which it is located or an insulating coating (not shown) should be positioned between the chip 12 and the fastener 32 at this bottom terminal 18. Because of this use of the holes 28 either they or the fastener 32 used with a hole 28 may be referred to as a third terminal or terminal means. Such a fastener 32 may also be utilized to hold a conventional terminal lug in place.

It will be noted from a consideration of FIG. 1 of the drawing that the resistor 10 is constructed so as to utilize a flange-like or bent end or portion 36 on the steel "chip" 12 extending outwardly from the remainder of the "chip" 12 at an angle of about 90° and so that one of the holes 28 and one of the holes 30 are located in this end 32. The use of such a bent end 36 enables the resistor 10 to be mounted in an essentially vertical orientation as shown in the drawing on an appropriate support 34. This is considered to be advantageous intending to save space on the surface of the support 34. It is also considered to be advantageous for another less obvious reason. If for any reason the resistor 10 should flex or vibrate either as a result of receiving a physical blow or as a result of the manner in which this resistor 10 is used, the portions of the "chip" 12 which are unsupported on the support 34 will normally flex to the limit amount normally necessary to accommodate such vibration. This minimizes the chances of the resistor 10 being damaged.

It is not to be assumed from the preceding discussion that the resistor 10 must always be mounted through the use of a fastener such as the fastener 32 previously described. If desired, the resistor 10 can be secured in place by welding the "chip" 12 to an appropriate member such as, for example, a wall within a larger machine or the like. Whenever the "chip" 12 is secured in place in this manner it is considered obvious that it is grounded. When a resistor 10 is mounted in this manner for it to be utilized as an RC network a connection must be made between an extension 20 and either the "chip" 12 or the metal member upon which the resistor 10 is mounted. Such a connection may be made in a variety of different ways including through the use of solder or, on occasion, a deposit laid down by welding.

I claim:

1. In a resistor comprising a substrate having a surface, a resistance element means located on said surface of said substrate, said resistance element means having ends, a resistor terminal means in contact with one of said ends, another resistor terminal means in contact with the other of said ends, both of said resistor terminal means being supported by said substrate, the improvement which comprises:

said substrate comprising an electrically conductive metal sheet having a dielectric coating adhered to one surface thereof, said dielectric coating serving as said surface of said substrate, and third terminal means for use in connecting said metal sheet to one of said resistor terminal means whereby said resistor may be utilized either as a resistor or as an RC network depending upon whether or not said third terminal means is connected to said metal sheet.

2. A resistor as claimed in claim 1 wherein:

said dielectric coating is a porcelain coating.

3. A resistor as claimed in claims 1 or 2 wherein:

said metal sheet is a steel sheet.

4. A resistor as claimed in claim 3 wherein:

said metal sheet is larger than said resistance element, said third terminal means comprises a hole extending through said metal sheet and one of said resistor terminal means.

5. A resistor as claimed in claim 4 wherein:

a portion of said sheet extends at an angle of about 90° to the remainder of said sheet, said portion being adapted to be secured to a supporting surface.

6. A resistor as claimed in claim 5 wherein:

said hole extends through said portion.

* * * * *